United States Patent [19]

Bush et al.

[11] Patent Number: 4,934,172

[45] Date of Patent: Jun. 19, 1990

[54] COMPRESSION TOOL FOR VARIOUS SIZES AND SHAPES

[75] Inventors: Austin L. Bush; Jerald C. Todd, both of Birmingham, Ala.

[73] Assignee: Square D Company, Palatine, Ill.

[21] Appl. No.: 328,826

[22] Filed: Mar. 27, 1989

[51] Int. Cl.[5] ..... B21D 7/06

[52] U.S. Cl. ..... 72/410; 72/453.16; 72/416; 29/751

[58] Field of Search ..... 72/410, 409, 453.16, 72/416, 472; 29/751; 81/418, 419

[56] References Cited

U.S. PATENT DOCUMENTS

| | | | |
|---|---|---|---|
| 601,262 | 3/1898 | Keithley | 72/416 |
| 2,096,173 | 10/1937 | Guerrini | 72/410 |
| 2,256,382 | 9/1941 | Dole | 72/410 |
| 2,369,180 | 2/1945 | Rosenthal | 29/751 |
| 2,647,814 | 8/1953 | Chilton | 72/410 |
| 3,015,824 | 1/1962 | Richardson | 72/410 |
| 3,332,272 | 7/1967 | Tonchen | 72/410 |
| 3,396,571 | 8/1968 | Porter | 72/410 |
| 4,109,504 | 8/1978 | Rommel | 72/452 |
| 4,667,502 | 5/1987 | Bush et al. | 72/453.16 |
| 4,723,434 | 2/1988 | Bush | 72/410 |

FOREIGN PATENT DOCUMENTS

| | | | |
|---|---|---|---|
| 678561 | 1/1964 | Canada | 72/410 |
| 250833 | 12/1985 | Japan | 140/92.1 |

*Primary Examiner*—Daniel C. Crane

*Attorney, Agent, or Firm*—Jose W. Jimenez; James Earl Lowe, Jr.; Larry I. Golden

[57] ABSTRACT

A compression tool (10) crimps both cylindrical (12) and "H" type (75) connectors. The jaws (22) of the compression tool have a first part which is defined by a nib area in which there is a nib (44) on either jaw and a base nib (46) which is moved into the nib area by a yoke (36) which is in turn moved by a manually operated hydraulic section (18) of the tool. Operation of the hydraulic section causes the nibs to converge upon a connector placed therebetween to effect the crimp. Alternatively, a connector, e.g., an "H" type connector, may be placed in a second part of the jaws. The second part includes opposing "C" shaped sections which also effect a crimp in response to the hydraulic operation. Additionally, the tool is adaptable to receive dies (76 and 78) which allow customized crimping and cutting.

20 Claims, 2 Drawing Sheets

COMPRESSION TOOL FOR VARIOUS SIZES AND SHAPES

TECHNICAL FIELD

This invention relates generally to compression tools, and more particularly to hand operated compression tools for exerting a large compression force.

BACKGROUND ART

A number of compression tools have been developed for compressing metal connectors about electrical conductors to form an electrical and structural connection between two conductors, or between a conductor and a terminal. When two conductors are connected, each conductor end is inserted into an open end of a connector. The connector is then exteriorly compressed by the compression tool to mechanically lock the conductors to the connector and to establish electrical continuity between them.

There are currently many types of connectors in use. One type commonly used is of a cylindrical configuration, called a sleeve connector, which will connect two conductors together in a straight line. A variation of this type provides a cylindrical section with a flat portion for connection of a conductor to a terminal. Another type of connector in common use is of an "H" type design, called a parallel tap connector, which has two parallel open sections. A conductor is inserted in each open section, and then, by compression, the open ends of the connector are closed and locked over the conductors by the compression tool.

One type of compression tool which secures a die for crimping both cylindrical connectors and "H" type connectors is described in U.S. Pat. No. 4,480,460, Bush et al., assigned to the present assignee and incorporated herein by reference. Using this type of compression tool, certain sizes of cylindrical connectors may be crimped between the jaws without adjustments or additional parts. Crimping of "H" type connectors, however, requires the removal and reversal of a part in the base of the unit. This extra step, unfortunately, is burdensome.

Another burdensome step which must be employed with this type of compression tool involves a latch mechanism which locks the jaws of the tool. For certain types of connector/conductor combinations, the latch must be opened to insert the combination, and then closed and pinned to hold the combination in place before crimping the connector. The pin is typically secured to one of the tool's jaws. When closed, the pin is inserted through a hole in the tool's other jaw. These steps are inconvenient not only because they impede the crimping process, but because they are difficult to perform when crimping in a confined work-space.

Another inconvenience resulting from this type of latching mechanism involves energized line applications, i.e., electricity flowing through the line to be crimped. Energized lines are sometimes crimped with special precautionary measures taken, such as the wearing of insulated gloves. When crimping is performed using a compression tool having this type of latching mechanism, the added manipulation of the pin while the connector/conductor combination is placed in the jaws is cumbersome.

There is therefore a need for a compression tool which overcomes the problems set forth above.

DISCLOSURE OF INVENTION

It is a general object of the present invention to provide a compression tool head assembly which alleviates the previously discussed deficiencies.

It is a more particular object of the present invention to provide a compression tool head assembly which, without adjustment or any latching mechanism, can crimp various shaped connectors, such as the "H" type connector and the cylindrical type connector.

It is another object of the present invention to provide a compression tool which has a latchless design and which is adaptable to receive various size dies to accommodate crimping of "H" type connectors ranging from the smaller 0 size connectors to the larger N size dies.

In accordance with a preferred embodiment incorporating the present invention, the foregoing objects are realized by a compression tool for crimping both the "H" connector and the cylindrical type connector which includes jaws that do not have to be latched together. The compression tool includes a base with a piston-like device at one end and a crimping head which is secured on the one end of the base. The base provides a force to move the piston-like device toward the end thereof. The crimping head includes a pair of jaws having a first part and a second part. The first part is designed to employ the interaction of three nibs; a base nib coupled with and responsive to the movement of the piston-like device, and a side nib on each jaw. The nibs form a nib area for receiving a connector therebetween. The second part is located at a further distance from the base than the first part, and it includes a receiving section, e.g., "C" shaped, on each jaw for receiving a connector therein.

Preferably, the nibs of the compression tool are pointed so as to provide focused pressure at points of the connector. Further, each jaw preferably includes a mounting area for mounting conventional or special dies thereon which fit either about the nib area or within the receiving section of the second part for crimping differently sized connectors.

BRIEF DESCRIPTION OF DRAWINGS

Other objects and advantages of the invention will become apparent upon reading the following detail description and upon reference to the drawings in which.

Figure 1:
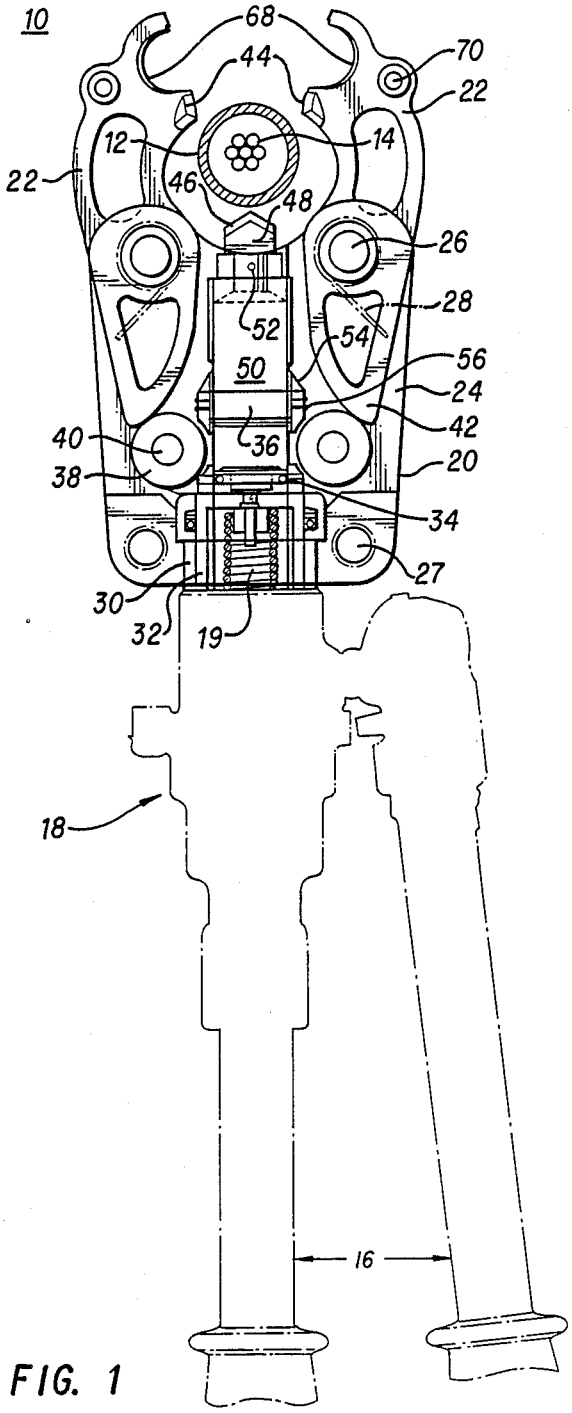
FIG. 1 is a front view of a hand-held compression tool exposing the pertinent internal parts, according to the present invention.

While the invention is susceptible to various modifications and alternative forms, specific embodiments thereof have been shown by way of example in the drawings and will be described in detail herein. It should be understood, however, that it is not intended to limit the invention to the particular forms disclosed. On the contrary, the intention is to cover all modifications, equivalents, and alternatives falling within the spirit and scope of the invention as defined by the appended claims.

BEST MODES FOR CARRYING OUT THE INVENTION

The present invention is useful for crimping cylindrical and specially shaped connectors (e.g., "H" type) about conductors by hand, as well as for cutting various types of conductors and cables. The present invention is especially useful in situations involving confined workspaces and or involving energized line crimping. In any of these situations, the present invention provides a compression tool which facilitates the crimping operation.

A front view of such a compression tool is illustrated in FIG. 1. The compression tool, depicted as 10, is shown with its front cover removed and in operating position to crimp a cylindrical connector 12 about a conductor 14. The compression tool 10 includes conventional operating levers 16 which are connected to a conventional hydraulic section 18, which is in turn secured with a head section 20. The hydraulic section 18 includes a retraction spring 19 which is coupled to the rigid column 32.

The head section 20 includes opposing jaws (or arms) 22 which converge on a connector, e.g., connector 12, placed therebetween. Head section 20 is rotatably secured to cylinder 30. Cylinder 30 is disposed around rigid column 32 and is connected to hydraulic section 18. Rigid column 32 includes two holes to receive set screws 34 for securing a yoke 36. The hydraulic section 18, in response to the operating levers 16, moves the yoke 36 and associated rollers 38 toward the jaws 22.

The jaws 22 include a cam surface 42. The jaws 22 are secured to the front and back aluminum covers 24 (front cover removed) via pins 26 which provide pivotal movement therefor, while bolts 27 secure the covers to one another. Springs 28 bias the jaws 22 in an open position. The rollers 38, which are pivotally secured to the yoke 36 by pins 40, contact the edges of the jaws 22 to force the bottom of the jaws 22 in the outward direction, thereby forcing the top of the jaws 22 to close about 10 the connector 12.

The novel head section 20 may be used with any conventional hydraulic system or other type of system which is designed to move a piston-like device, e.g., yoke 36. For examples of such known systems, reference may be made to U.S. Pat. No. 3,154,981, issued to McDurmont and to the following issued to Bush et al., U.S. Nos. 4,581,894, 4,667,502, and 4,723,434. Each of the above patents is assigned to the present assignee and incorporated herein by reference.

Crimping of the connector 12 is caused by the three nibs; a nib 44 of each respective jaw, and a nib 46 of an insertable and removable die 48. The die 48 is secured to the top of an aluminum spacer 50 via a lock pin 52. The spacer 50 is secured to the yoke 36 by spring clamps 54 which are mounted on the yoke 36 by screws 56. The spacer 50 is designed to be removed with the die 48. When the hydraulic section 18 moves the yoke 36, the nib 46 of die 48 along with nibs 44 crimp the connector 12 onto the conductor 14.

Figure 2:
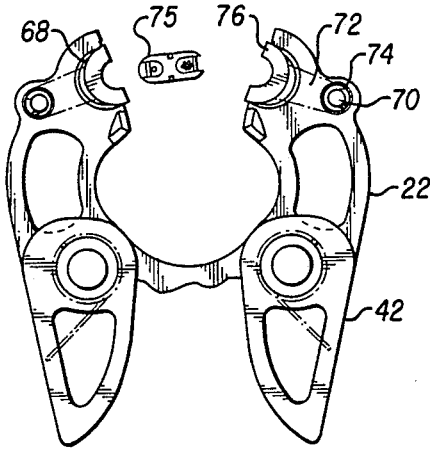
FIG. 2 is a front view of the jaws of the head portion of the compression tool of FIG. 1, including standard dies mounted thereon in accordance with the present invention.

The novel head section 20 is designed not only to crimp cylindrically shaped connectors such as connector 12 shown in FIG. 1, but also specially shaped connectors such as "H" type connector 75 shown in FIG. 2. This is accomplished by including two types of connector receiving parts in the jaws 22. The first part is formed by the nibs 44 and the nib 46 for receiving the connector 12 as described above with FIG. 1. The second part is formed by opposing sections 68. The sections 68 are preferably "C" shaped to receive a series of "H" type connectors therebetween.

The present invention significantly facilitates the crimping process when the type of connector to be crimped varies. Because the jaws 22 are structured to crimp a designated size of specially shaped connectors such as the "H" type as well as a designated size of the cylindrically shaped type, burdensome adjustments and/or part substitutions are typically avoided. In addition, this design avoids the burdensome requirement of previously known compression tools that the jaws be latched.

Referring now to FIG. 2, the jaws 22 of the compression tool 10 are illustrated with a die pair 72 mounted thereon. The die pair 72 is conventional, available for example from Square D Company, Anderson Products, Leeds, Alabama. It may be used for receiving and crimping a smaller range of "H" type connectors in the sections 68. For example, while the sections 68 may be adaptable to crimp "D" size "H" type connectors without the die pair 72, the die pair 72 may be used to crimp "0" size connectors when mounted on the jaws 22.

The die pair 72 is mounted on the jaws 22 using a pin 70 which protrudes outwardly from the face of the jaw. A fastener 74 is used to secure each die thereon. The "C" shaped portion 76 of each die includes a shoulder which rests in the section 68 of the associated jaw. When used in this manner, the nib area of the jaws 22 is unused.

Figure 3:
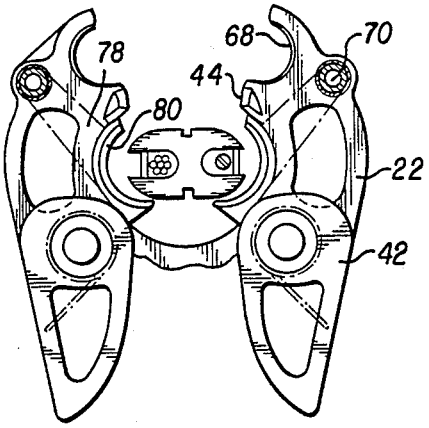
FIG. 3 is a front view of the jaws of the head portion of the compression tool of FIG. 1 including special dies mounted thereon in accordance with the present invention.

In FIG. 3, the jaws 22 of the compression tool 10 are illustrated employing a similar die in the nib area of the jaws. In this application, a specially manufactured die pair 78 is mounted on the jaws for receiving and crimping a larger range of "H" type connectors in the nib area. For example, the die pair 78 may be used to crimp "N" size connectors.

The die pair 78 is mounted on the jaws 22 using the same pin 70 as is used in FIG. 2 with a similar fastener 74. The "C" shaped portion 80 of each die includes a shoulder which rests in the section 68 of the respective jaw beneath the nibs 44. The "C" shaped portion 80 includes an open face that is directed at a slight angle off the perpendicular with respect to the length of the die. The spacer 50 and the die 48 are removed before the die pair is mounted on the jaws 22.

Alternatively, the die pair 76 or 78 may include cutting edges rather than "C" shaped portions. This allows the compression tool to operate as a cable or conductor cutter rather than as a crimping type compression tool.

Figure 4:
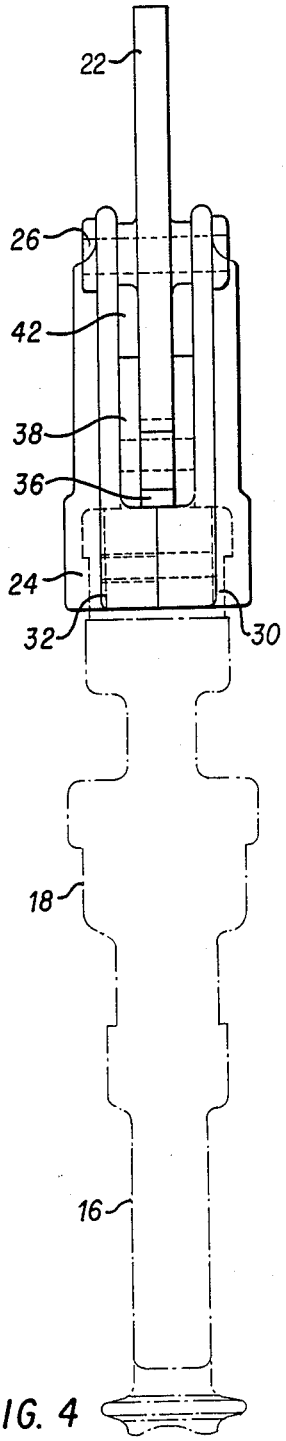
FIG. 4 is a side view of the compression tool illustrated in 15 FIG. 1.

In FIG. 4, a side view of the compression tool is shown. This view includes an illustration of the front and back covers 24 which support the jaws 22.

While the invention has been particularly shown and described with reference to a preferred embodiment, as mentioned above, it will be understood by those skilled in the art that various modifications and changes may be made to the present invention without departing from the spirit and scope thereof.

We claim

1. A compression tool head assembly, responsive to a base which includes a piston-like device at one end thereof and which forces the piston-like device to move in an outwardly direction with respect to the base, comprising:

mounting means for mounting the head assembly on the one end of the base;

a pair of jaws, each jaw having a first part and a second part coupled to the mounting means, for converging upon a structure placed between the jaws in response to the movement of the piston-like device;

the first part having a nib area which employs a side nib on each jaw; and the second part, disposed adjacent to the first part and at a further distance from the base than the first part, having a connector receiving section on each jaw, said connector receiving section being generally C-shaped, with the opening of one connector receiving section facing the opening of said other connector receiving section, and a crimp die pair, each crimp die being associated with a different one of said jaws and comprising:

an elongated metal member having a first end and a second end;

receptacle means at the first end for securing the member to the associated jaw;

at the second end, a "C" shaped portion having an open face that is directed at an angle off the perpendicular with respect to the first end - second end line and toward the second end; and also at the second end, a shoulder having a curvature for resting within the nib area.

2. The compression tool head assembly, as set forth in claim 1, wherein each of the nibs includes a pointed end.

3. The compression tool head assembly, as set forth in claim 1, wherein each jaw includes means for mounting dies thereon for crimping differently sized connectors.

4. The compression tool head assembly, as set forth in claim 3, wherein each said jaw includes means for coupling the dies about the nib area.

5. The compression tool head assembly, as set forth in claim 3, wherein each said jaw includes means for coupling the dies within the connector receiving section.

6. The compression tool head assembly, as set forth in claim 5, wherein each jaw includes means for coupling the dies within both the connector receiving section and about the nib area.

7. The compression tool head assembly, as set forth in claim 1, wherein the nibs are situated in the nib area to crimp cylindrically shaped connectors.

8. A compression tool head assembly, responsive to a base which includes a piston-like device at one end thereof and which forces the piston-like device to move in an outwardly direction with respect to the base, comprising:

mounting means for mounting the assembly on the one end of the base;

a pair of jaws, having a first part and a second part coupled to the mounting means, for converging and applying force to a connector placed therebetween in response to the movement of the piston-like device;

die coupling means, secured to the pair of jaws, for coupling die pieces thereto for crimping differently sized connectors;

the first part having a nib area which employs a side nib on each jaw and a base nib which is interactable with and responsive to the movement of the piston-like device, and having means for supporting the die pieces beneath the side nibs; and the second part, disposed adjacent to the first part and at a further distance from the base than the first part, having a connector receiving section on each jaw.

9. The compression tool head assembly, as set forth in claim 8, wherein each connector receiving section includes means for supporting a die coupled to the associated jaw.

10. The compression tool head assembly, as set forth in claim 8, wherein each of the nibs includes a pointed end to meet the connector.

11. The compression tool head assembly, as set forth in claim 8, wherein the connector receiving section is shaped to crimp specially shaped connectors.

12. The compression tool head assembly, as set forth in claim 8, wherein the nibs are situated in the nib area to crimp cylindrically shaped connectors.

13. The compression tool head assembly as set forth in claim 9 wherein said assembly further includes a crimp die pair, each crimp die being associated with a different one of said jaws and comprising:

an elongated metal member having a first end and a second end;

receptacle means at the first end for securing the member to the associated jaw;

at the second end, a "C" shaped portion having an open face that is directed at an angle off the perpendicular with respect to the first end - second end line and toward the second end; and also at the second end, a shoulder having a curvature for resting within the nib area.

14. A compression tool head assembly, responsive to a base which includes a piston-like device at one end thereof and which forces the piston-like device to move in an outwardly direction with respect to the base, comprising:

mounting means for mounting the assembly on the one end of the base;

support members rigidly secured to the mounting means;

a roller assembly coupled to the support members and, in response to the movement of the piston-like device, movable in a direction parallel to the base-piston line;

a pair of jaws, pivotally coupled to the support members, for converging upon a connector inserted between the jaws in response to the movement of the roller assembly;

the jaws including a first part and a second part and including coupling means for coupling die pieces thereto for crimping differently sized connectors;

the first part having a nib area which employs a side nib on each jaw and a base nib which is interactable with and responsive to the movement of the piston-like device, and having means for supporting the die pieces; and the second part, dispose adjacent to the first part and at a further distance from the base than the first part, having a "C" shaped section on each jaw, and having means for supporting a die coupled to the associated jaw.

15. The compression tool head assembly, as set forth in claim 14, wherein each of the nibs includes a pointed end to meet the connector.

16. The compression tool head assembly, as set forth in claim 14, wherein the support members substantially enclose the roller assembly and the cam members.

17. The compression tool head assembly, as set forth in claim 14, wherein the base nib is removably coupled to the piston-like device via a spacer.

18. The compression tool head assembly, as set forth in claim 17, wherein the spacer is removably coupled to the piston-like by spring clamps.

19. The compression tool head assembly, as set forth in claim 14, wherein the "C" shaped section is shaped to crimp "H" type connectors.

20. The compression tool head assembly, as set forth in claim 14, wherein the nibs are situated in the nib area to crimp cylindrically shaped connectors.

* * * * *